US005613619A

United States Patent [19]

Van Melle

[11] Patent Number: 5,613,619

[45] Date of Patent: Mar. 25, 1997

[54] FOLDBACK CUP LID HAVING COMFORTABLE DRINKING CHARACTERISTICS

[75] Inventor: Hugh Van Melle, Etobicoke, Canada

[73] Assignee: Amhil Enterprises Ltd., Mississauga, Canada

[21] Appl. No.: 549,519

[22] Filed: Oct. 27, 1995

[51] Int. Cl.[6] ..... A47G 19/22

[52] U.S. Cl. ..... 220/712; 220/254; 220/269; 220/793

[58] Field of Search ..... 220/709, 711, 220/712, 713, 254, 268, 269, 306

[56] References Cited

U.S. PATENT DOCUMENTS

| | | | |
|---|---|---|---|
| 3,994,411 | 11/1976 | Elfelt et al. | 220/712 |
| 4,421,244 | 12/1983 | Van Melle | 220/306 |
| 4,473,167 | 9/1984 | Bailey | 220/712 |
| 4,629,088 | 12/1986 | Durgin | 220/254 |
| 4,738,373 | 4/1988 | DeParales | 220/254 |
| 5,090,584 | 2/1992 | Roberts et al. | 220/712 |
| 5,111,961 | 5/1992 | Van Melle | 220/712 |
| 5,183,172 | 2/1993 | Boller | 220/270 |
| 5,197,624 | 3/1993 | Dodaro | 220/254 |
| 5,335,812 | 8/1994 | Boller | 220/709 |
| 5,348,181 | 9/1994 | Smith et al. | 220/254 |

FOREIGN PATENT DOCUMENTS 1236426 5/1988 Canada .

*Primary Examiner*—Stephen K. Cronin
*Attorney, Agent, or Firm*—Donald H. Hewson

[57] ABSTRACT

A disposable cup lid is provided for covering the open end of a beverage cup, especially a hot drinks cup for beverages such as coffee. The cup lid is a foldback lid, whereby an opening is formed in the lid by lifting and tearing the material of the cup lid at a designated portion of the rim thereof, then peeling back the drink-through portion of the lid, with the edges of the drink-through portion of the lid being defined by an orientation grain in the lid caused by extrusion of the sheet material from which it is formed. Two additional tab portions are formed into the rim of the lid, one at either side of the position where the grasp tab is located, so as to present forwardly extending tabs which are gently rounded at each edge of the drink-through portion of the lid after it has been formed, and thereby so as to preclude sharp edges at each edge of the drink-through portion being presented to the lips and tongue of the user.

11 Claims, 3 Drawing Sheets

FOLDBACK CUP LID HAVING COMFORTABLE DRINKING CHARACTERISTICS

FIELD OF THE INVENTION

This invention relates to disposable cup lids, and particularly cup lids which are intended for use with hot beverages such as coffee and the like. The cup lids of the present invention are intended for placement over disposable hot drink cups, being the sort of single use cup in which hot drinks are vended from machines, from street vendors, from coffee and donut shops, and the like.

BACKGROUND OF THE INVENTION

The use of disposable cup lids on disposable, single use hot drink cups, has been known for many years. The disposable cup lids are generally vacuum formed from thin sheets of extruded polystyrene plastic. Other thermoformed sheet plastics materials may also be used. The lids are formed using thermo- and vacuum-forming machines, whereby the thin polystyrene sheet is pulled down over or into a male or female mold, respectively, cooled, stripped from the mold, and stamped or die cut so as to form discrete cup lids. In the North American markets alone, and in the European markets, literally millions of such disposable cup lids are manufactured for single use purposes, used in the respective hot drink markets, and then disposed of, every day.

It has been known for some time that, when the thin sheet of polystyrene plastic is extruded, an orientation grain is formed in the sheet of polystyrene material. The orientation grain acts in such a manner that the polystyrene material can be torn easily in a direction along the orientation grain, but is much more difficult to tear or fracture in a direction perpendicular to or otherwise at an angle to the orientation grain. This fact, in turn, in taken advantage of in manufacturing disposable cup lids especially for use with hot drinks, whereby a so-called "foldback cup lid" is formed. In this manner, a drink-through portion can be formed in the cup lid when the purchaser of the hot drink desires to consume that beverage.

The drink-through portion of the cup lid is generally a small portion formed at the periphery thereof and extending more or less radially but more generally along the extrusion lines formed in the material of the cup lid, into the interior cover or panel portion of the cup lid. This permits an opening to be formed in the lid, whereby the cup with that opening formed in its lid may be brought to the mouth of the user, and the beverage consumed. Moreover, the configuration of a drink-through lid also permits the lid to otherwise remain in place over the major portion of its area, thereby retaining steam or warm vapour within the confines of the covered cup and thereby reducing the rate at which the beverage will cool.

However, whenever a drink-through portion of a cup is formed by peeling back or tearing out a small portion of the cup lid, such a step involves breaking or tearing the rim or skirt of the cup lid, across a small portion thereof, and then tearing or folding back the rim and the adjoining portion of the panel of the cup lid. This, in turn, results in sharp edges at each side of the opening or gap thereby formed in the rim or skirt of the cup lid. Very often, however, those sharp edges may be uncomfortable to the lips and/or the tongue of the user. This, in turn, may tend to negate the purpose for the foldback portion of the cup lid because if the user rejects the discomfort due to the sharp edges defining the drink-through portion, then the user may simply opt to discard the cup lid in its entirety. This, in turn, will lead to faster cooling of the hot drink, and prospectively as well to an increased risk of spillage.

Moreover, particularly with drink-through lid having a foldback portion, it is not uncommon for the foldback portion to be not well retained in its folded back configuration, due at least in part to the elastic memory characteristic of the material of the cup lid, so that that folded back portion may be awkwardly in place in such a manner that it may interfere with the upper lip or even the nose of the user as she or he attempts to drink a beverage from the cup. This also may result in a decision by the user, therefore, simply to opt to discard the cup lid in its entirety.

The present inventor has discovered, quite unexpectedly, that an improved cup lid having a drink-through portion can be provided, presenting advantages over prior art cup lids which otherwise provide drink-through lids, by configuring the rim of the cup lid, and the central panel thereof, in manners to be described in greater detail hereafter.

DESCRIPTION OF THE PRIOR ART

Among prior art patents which describe drink-through lids, there are included the following:

Canadian patent No. 1,236,426 issued May 10, 1988 to BOLLER et al, for a drink-through container lid. That lid is a disposable lid which is specifically intended for friction fit over an open mouth container, such as those formed from expanded polystyrene beads. In any event, the disposable lid is formed such that it has an outer annular skirt whose lower end is outwardly flared into an annular flange. In that flange, there are formed two spaced apart ribs located within a single quadrant of the lid and which define a notch in the bottom surface of the outer peripheral edge of the lid. This provides a fracture control means within the one quadrant. However, the formation of the lid requires precise blanking and cutting; and it must not be overlooked that the purpose of the notches is merely to promote fracture or breakage of the material of the cup lid at the periphery thereof.

U.S. Pat. No. 5,111,961 issued May 12, 1992 to the inventor herein, and is commonly owned. That patent teaches a thin plastic disposable cup lid having a small foldback portion that is partially removed from the remainder of the lid by being torn along tear lines that are coincident with the oriented fibres of the plastic material. According to that invention, there is no requirement for pre-formed score lines, slits, or notches, so as to facilitate proper tearing of the lid. The foldback portion is hinged, and means are provided to retain that foldback portion in an engaged position when it is folded back over the formed hinge in the lid. A tab is provided in one portion of the outer portion of the outer periphery of the lid, in an outwardly directed flange, to provide a portion thereof which can be gripped in the fingers of the hand so as to initiate the tearing and folding back operation. However, the overall configuration of the central panel of the lid is generally planar, so that the foldback portion is retained in a position above the plane of the lid.

U.S. Pat. No. 5,348,181 issued Sep. 20, 1984 to SMITH et al teaches a winged cup lid, whereby one or a pair of tabs that extend from the cover portion of the lid may be folded downwardly to provide a gripping area which is otherwise insulated from the cup. The cup lid may optionally include an openable flap which is defined at its outer circumference by a frangible line of weakness, and along its two sides by a pair of frangible lines of weakness. However, at least the circumferentially formed frangible line of weakness must be stamped or die cut in order to ensure that the material of the cup lid will fracture in the appropriate place. A recess is formed to receive the flap, after it is folded back over its hinge, to be retained within the recess. The principal feature is that, because the circumferential frangible line which defines the outside of the drink-through portion is interiorly located inside the inside rim of the beverage cup, hoop stress around the entire rim of the beverage cup is maintained. However, the drink-through portion is awkwardly located.

DODARO U.S. Pat. No. 5,197,624 teaches a cup lid having a peripheral flange and a central portion which contains a reclosable access closure flap which may be selectively moved between an open and a closed position. In this case, a horizontally directed pull tab is formed at the outer periphery of the lid, and an upstanding retainer element is formed in the central portion of the lid. When the foldback portion is folded back into place, at least the pull tab thereof is retained in a position which may be above the plane of the cup lid and which could interfere with the upper lip and/or nose of the user.

U.S. Pat. No. 5,183,172 issued Feb. 2, 1993 to BOLLER describes a drink-through container lid having a lift tab which is positioned above the bottom of the remainder of the skirt so that, when it is intended to fracture the lid to form the foldback portion, less force is required to initiate fracturing. This reduces the likelihood that the entire lid will become separated from the container.

U.S. Pat. No. 5,090,584 issued Feb. 25, 1992 to ROBERTS et al, and teaches a disposable container lid having an access strip which is provided with a pair of tear impressions extending from the rim to a hinge means located in the central portion of the lid. The access strip is folded back and pushed against the central portion of the lid in such a manner that the deflection flap is intended to be deflected downwardly towards the contents of the container. Small retaining flaps spring past the sides of the access strip of the foldback portion and overlap those sides. Manufacture of the disposable container lid requires very precise vacuum forming and die cutting, to manufacture the lids.

SUMMARY OF THE INVENTION

In accordance with one aspect of the present invention, there is provided a disposable cup lid for covering the open end of a beverage cup, which cup lid is formed from an extruded thermoplastic sheet material having an orientation grain caused by the extrusion. The disposable cup lid of the present invention comprises a cover portion and a lip portion, where the lip portion defines a downwardly facing cavity around the cover portion, which cavity is adapted to receive a corresponding rim on the beverage cup. The cover portion is generally planar, and has a foldback portion therein located near the periphery of the cover portion and extending into the lip portion, where the foldback portion spans a minor segment of the cover portion and the lip portion. There is a "U"-shaped hinge portion formed in the cover portion and subtending the foldback portion, and a grasp tab which is formed adjacent the lip portion and extending outwardly from the periphery thereof in a plane which is generally parallel to the plane of the cover portion. The foldback portion has first and second sides, and first and second ends; where the first end is coincident with the grasp tab and the second end is coincident with the "U"-shaped hinge. The first and second sides are coincident with, and thereby are formed in the same direction as, the orientation grain. However, the rim further comprises two additional tab portions which are co-planar with the grasp tab, with the additional tab portions being located one on either side of the grasp tab and separated therefrom by notches that are formed in the rim. Each notch terminates in a vertex which is generally in the region of the intersection of the plane of the grasp tab and the additional tab portion, together with the lip portion. Each of the additional tabs which faces each respective notch is formed so as to be curved away from the vertex.

Moreover, in accordance with another aspect of the present invention, there is provided a cup lid which is generally as described above, and in which a pair of generally radially extending and upstanding grasping ridges are formed in the cover portion adjacent the lip portion and radially inwardly from the grasp tab. There is also a securing protrusion formed radially in line with the pair of grasping ridges and spaced away from the "U"-shaped hinge at the side thereof which is remote from the grasping ridges; and the securing protrusion is located within a recess that is formed below the general plane of the cup lid so that the protrusion is generally in the plane of the lid. The spacing between the grasping ridges and the width of the securing protrusion are such that the grasping ridges and the securing protrusion are co-operative with each other to lock the foldback portion of the cup lid in a folded back configuration. Thus, the portion of the rim between the grasp tab and the grasping ridges will extend downwardly into the recess when the foldback portion is folded back into the folded back configuration, and thus will be less likely to interfere with the upper lip and/or nose of the user.

In the cup lids of the present invention, each curved portion of each of the additional tabs may be formed so that it is a portion of a circumference of a circle, and it may be specifically in the form of an arc of approximately 90°. Moreover, the portion of each of the additional tabs which is remote from each respective notch may be generally curved towards the lip portion of the cup lid; and in that sense, that additional curved portion may be in the form of a portion of a circumference of a circle or it may also take the form of an arc of approximately 90°. Finally, the portion of each of the additional tabs remote from each respective notch may take the form of a tangent drawn from the outer edge of each additional tab to the lip portion at each respective side of those additional tabs.

There is thus provided a disposable cup lid whose purpose is to present a cup lid which eliminates the sharp corners at each edge of the opening that exist after the foldback has been formed at the edges thereof, in the outer skirt or lip of the cup lid. Discomfort to the mouth, particularly to the lips and/or the tongue of the user, are thereby substantially precluded.

BRIEF DESCRIPTION OF THE DRAWINGS:

The present invention will be described hereafter, in association with the accompanying drawings which describe the invention for purposes of illustration thereof, and in which.

DETAILED DESCRIPTION OF THE PREFERRED EMBODIMENTS:

Reference will now be made to FIGS. 1 through 5.

Two general embodiments of the present invention are illustrated. The first embodiment is that which is shown generally in FIGS. 1, 2, and 3; the second embodiment is shown in FIGS. 4 and 5. However, as will become evident hereafter, the cross-section shown in FIG. 5 will apply equally to the first embodiment as well as to the second embodiment. As will be noted hereafter, the principal difference in those embodiments resides specifically in the configuration of a pair of additional tabs which are provided to the cup lid, adjacent each side of the grasp tab by which the tearing back of the foldback portion of the cup lid may be initiated.

In may respects, the general configuration of cup lids in keeping with the present invention is not unlike the configuration of cup lids shown in the inventor's prior U.S. Pat. No. 5,111,961, referenced above.

Figure 1:
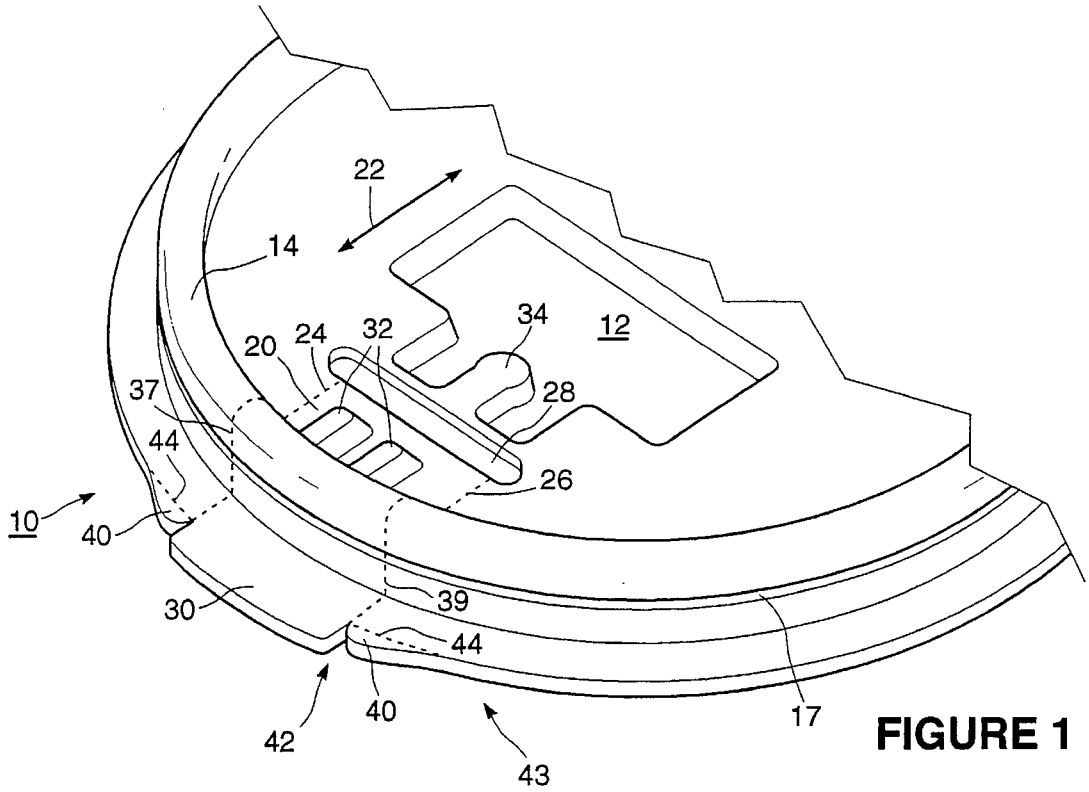
FIG. 1 shows a portion of a cup lid in keeping with the present invention, in perspective.

Thus, the principal features of cup lids in keeping with the present invention, such as the cup lid 10 shown in FIG. 1, are as follows, where the same reference numerals are used for similar structural components of the cup lid of the present invention in all embodiments, as described.

The cup lid 10 has a cover portion 12, and a lip portion 14. The cover portion 12 generally spans across the opening of a cup when the lid 10 is placed thereon, with the edges or rim of the cup surrounding its mouth being received in the lip portion 14. Thus, the lip portion defines a downwardly facing cavity 16, indicated in FIG. 5, which is adapted to receive a corresponding rim on the beverage cup over the mouth of which the cup lid is placed.

There may be an area of the lip portion 14 which has a reduced diameter, as shown at 17. The reduced waist portion 17 may contribute to the manner in which the lip portion 14 and cavity 16 grip and accommodate the rim portion of the cup to which the disposable cup lid is fitted.

In general, the cover portion is generally planar, although it may have specifically formed features, as will be described hereafter, molded into it. In any event, there will be a foldback portion of the cup lid; not as the cup lid is manufactured, but as the disposable cup lid is fractured and torn when in use. That foldback portion is, however, to be formed in a particular portion of the cup lid, shown generally at 20 in FIG. 1. There is, as previously stated, an orientation grain which is caused by extrusion. The orientation grain, the direction of which is shown at 22, comes as a consequence of the extrusion in the polystyrene sheet material from which the disposable cup lid is formed. The edges 24 and 26, which will define the foldback portion 20 when it is formed, will generally be more or less in the same direction and .therefore parallel to the orientation grain 22.

The foldback portion 20 will, however, be subtended by or terminate at a generally "U"-shaped hinge portion 28 which is formed in the cover portion of the lid. This precludes the possibility that the foldback portion will tear too far into the interior region of the cup lid.

A grasp tab 30 is formed adjacent the lip portion 14, and the grasp tab 30 extends outwardly from the periphery of the lip portion 14 in a plane which is generally parallel to the plane of the cover portion 12. Thus, the grasp tab 30 extends more or less perpendicularly from the edge of the lip portion 14. It will be seen, therefore, that the foldback portion 20 is defined by sides 24 and 26, the "U"-shaped hinge portion 28, and the grasp tab 30.

As described in greater detail hereafter, disposable cup lids in keeping with the principals of this invention may incorporate certain features originally introduced in Applicant's U.S. Pat. No. 5,111,961. In particular, there may be provided a pair of ridges 32, which are adapted to co-operate with protrusion 34 to lock the foldback portion 20 in place when it is formed and folded back. However, as noted hereafter, it has been unexpectedly discovered that provision of a recess in the central panel of the lid will lead to less discomfort of the user.

Figure 2:
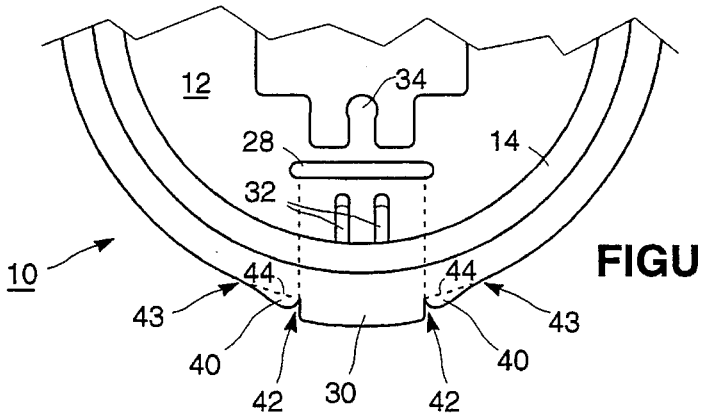
FIG. 2 is a plan view of a portion of the cup lid.
Figure 3:
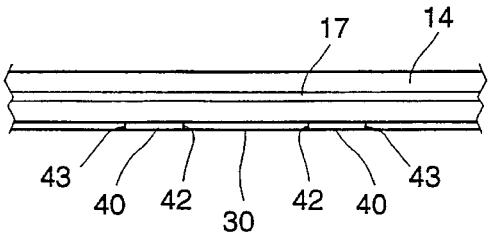
FIG. 3 is a side or edge view of that portion shown in FIG. 2.
Figure 4:
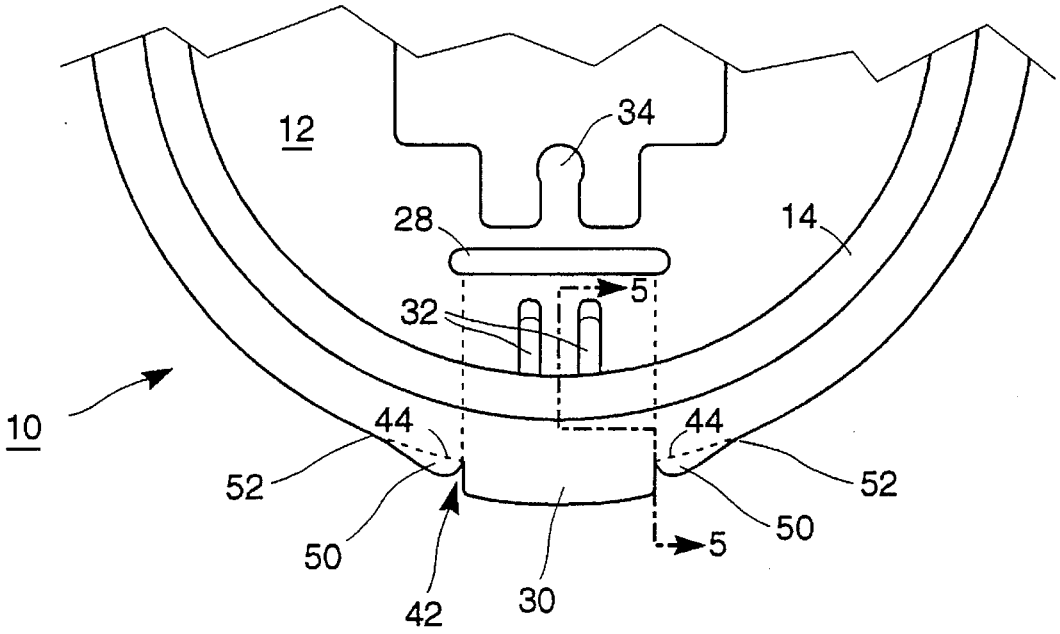
FIG. 4 is a plan view of another embodiment of the cup lid, otherwise similar to FIG. 2.
Figure 5:
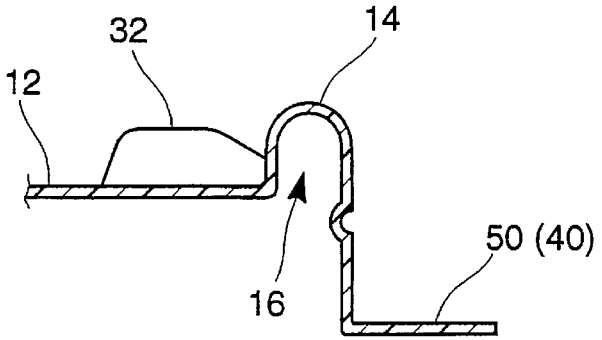
FIG. 5 is a cross-sectional view taken along the line 5—5 in FIG. 4.

In any event, however, when the foldback portion 20 is folded back—whether or not it is—and locked in place, the edges of the foldback portion which occur as shown at tear lines 37 and 39 could, at their lower extremities, present sharp points to the lips and/or tongue of the user were it not for the additional presence of tab portions 40 as shown in FIGS. 1, 2, and 3 (or tab portion 50 of FIGS. 4 and 5). Each of the additional tab portions 40 or 50 is located, one on either side, of the grasp tab 30. There are notches 42 which separate the tabs 40 from the grasp tab 30; and each of the notches 42 terminates in a vertex 44. Each vertex 44 is generally in the region of the intersection of the plane of the grasp tab 30 and of the additional tab portions 40 or 50, which are in the same plane, and are thus in the vicinity where the tabs intersect with the lip portion 14.

At least the portion of each of the tabs 40 or 50, which faces each of the respective notches 42, is curved away from the respective vertex 44.

The curved portion of each additional tab 40 or 50, which is adjacent the respective notches 42, may take the form of a portion of a circumference of a circle. It may also take the form of an arc of approximately 90°.

Moreover, the portion of each additional tab 40 which is remote from the respective notches 42 is gently curved or directed back towards the lip portion 14. That portion generally takes the form of a tangent which is drawn from the outer edge of each tab portion 40 to the edge of the lip portion of the cup lid at each respective side of the tabs 40 which is away from the notches 42. Each tab 40, therefore, ends in the region designated 43.

An alternative embodiment is shown in FIGS. 4 and 5; although, as noted, the cross-sectional view of FIG. 5 may apply as well to the embodiment of FIGS. 1, 2, and 3. In any event, the additional tabs 50 shown in FIG. 4 each also are separated from the grasp tab 30 by notches 42, each of which again terminates in a vertex 44. However, in this embodiment, the portion of each additional tab 50 which is remote from each respective notch 42 generally has an appearance which is somewhat that of an elongated semi-circle, ending in the region designated at 52. Each region 52 is, therefore, much closer to the respective edge of grasp tab 30 than are the regions 43 of the embodiment of FIGS. 1, 2, and 3.

It will be seen that, when in use and when the foldback portion 20 is formed by the user when he or she is about to consume the beverage from the beverage cup the tear lines 27 and 39 are formed, and the tabs 40 or 50 present themselves to the lips and/or tongue of the user, and thereby preclude the discomfort which the user might otherwise have experienced.

It is, of course, evident that the precise configuration of the additional tabs 40 or 50 is not specifically material, provided that they present to the lips and/or tongue of the user a curved outer surface so as to not be sharp and potentially painful. However, the embodiment of tabs 40 in FIGS. 1, 2, and 3 is easier for the consumer to use, since there is less likelihood that the tear lines 37 and 39 will occur other than in the positions shown in the drawings, as extension of each vertex 44. The disposable cup lids of the present invention, therefore, will better serve the purpose for which foldback cup lids were originally intended.

Figure 6:
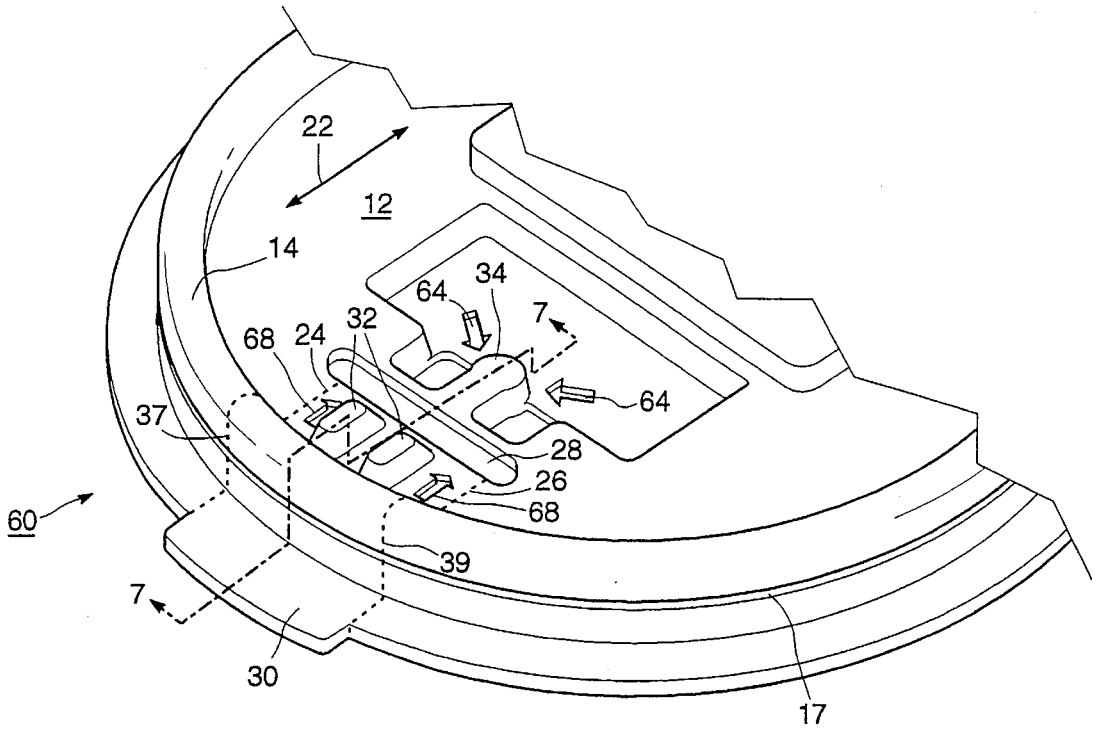
FIG. 6 shows a portion of a cup lid similar to FIG. 1, but showing another feature of the present invention, in perspective.
Figure 7:
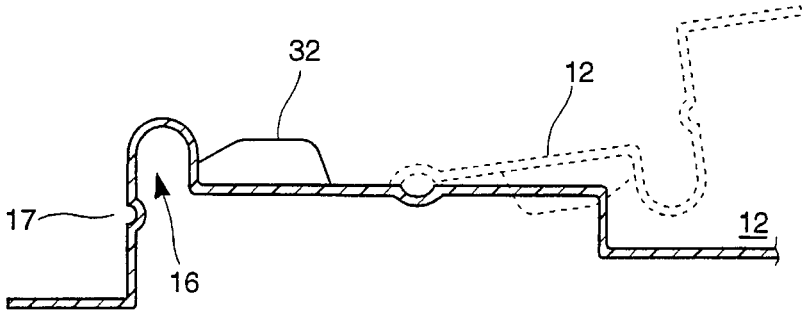
FIG. 7 is a cross-sectional view taken along the line 7—7 in FIG. 6.

Turning now to FIGS. 6 and 7, like reference numerals as indicated above are used wherever possible and/or necessary, for the same features of the cup lid illustrated in FIGS. 6 and 7. Here, the pair of grasping ridges 32 are shown to be generally radially extending and upstanding with respect to the general plane of the cover portion 12. They are formed in the cover portion adjacent the lip portion 14, and extend radially inwardly from the lip portion 14 and from the grasp tab 30. The securing protrusion 34 is formed radially in line with the pair of grasping ridges 32; and the location of the securing protrusion is radially in line with the grasping ridges 32 and spaced away from the "U"-shaped hinge 28 at the side thereof remote from the grasping ridges 32. Obviously, the spacing between the grasping ridges 32 and the width of the securing protrusion 34 are such that, when the grasping ridges are placed over the securing protrusion, and are co-operative with each other, the foldback portion 20 of the cup lid 60 will be locked into its folded back configuration, as shown generally in FIG. 7.

There is a recess 62 which is formed below the general plane of the cover portion 12 of the lid 60. Thus, as shown also in FIG. 7 in dotted or ghost outline, when the foldback portion 20 is in its folded back configuration, the outer portion of the lip portion 14 extends downwardly into the recess, and is thereby more clearly out of the way and less likely to interfere with the upper lip and/or nose of the user.

There may also be a pair of arrows 64 which are molded into the recess 62, and also a pair of arrows 68 which are molded into the cover portion of the lid 60 in the region thereof which will form the foldback portion 20. Each of the pairs of ribs 64 and 68 has the added characteristic that they provide stiffening ribs for the recess 62 and for the foldback portion 20.

Other modifications and alterations may be used in the design and manufacture of the apparatus of the present invention without departing from the spirit and scope of the accompanying claims.

What is claimed is:

1. A disposable cup lid for covering the open end of a beverage cup, where said cup lid is vacuum formed from an extruded thermoplastic sheet material having an orientation grain caused by extrusion, comprising:

a cover portion and a lip portion;

said lip portion defining a downwardly facing cavity around said cover portion and adapted to receive a corresponding rim of a beverage cup;

said cover portion being generally planar and having a foldback portion therein located near the periphery of said cover portion and extending into said lip portion, said foldback portion spanning a minor segment of said cover portion and said lip portion;

a "U"-shaped hinge portion formed in said cover portion and subtending said foldback portion;

a grasp tab formed adjacent said lip portion and extending outwardly from the periphery thereof in a plane which is generally parallel to the plane of said cover portion;

said foldback portion having a first side, a second side, a first end, and a second end; said first end being coincident with said grasp tab, said second end being coincident with said "U"-shaped hinge, and said first and second sides being coincident with said orientation grain;

wherein said rim further comprises two additional tab portions which are coplanar with said grasp tab, said additional tab portions being located one on either side of said grasp tab and separated therefrom by notches formed in said rim;

wherein each notch terminates in a vertex which is generally in the region of the intersection of the plane of said grasp tab and said additional tab portions together with said lip portion; and wherein at least the portion of each of said additional tabs which faces each respective notch is curved away from said vertex.

2. The disposable cup lid of claim 1, wherein said curved portion of each of said additional tabs is in the form of a portion of a circumference of a circle.

3. The disposable cup lid of claim 1, wherein said curved portion of each of said additional tabs is in the form of an arc of approximately 90°.

4. The disposable cup lid of claim 1, wherein the portion of each of said additional tabs remote from each respective notch is curved towards said lip portion.

5. The disposable cup lid of claim 4, wherein the portion of each of said additional tabs remote from each respective notch is in the form of a portion of a circumference of a circle.

6. The disposable cup lid of claim 4, wherein the portion of each of said additional tabs remote from each respective notch is in the form of an arc of approximately 90°.

7. The disposable cup lid of claim 4, wherein the portion of each of said additional tabs remote from each respective notch is in the form of a tangent drawn from the outer edge of each said additional tab to the lip portion at each respective side of said additional tabs.

8. The disposable cup lid of claim 1, wherein a pair of generally radially extending and upstanding grasping ridges are formed in said cover portion adjacent said lip portion and radially inwardly from said grasp tab;

a securing protrusion is formed radially in line with said pair of grasping ridges and spaced away from said "U"-shaped hinge at the side thereof remote from said grasping ridges; and a recess is formed below the general plane of said lid;

wherein the spacing between said grasping ridges and the width of said securing protrusion are such that said grasping ridges and securing protrusion are co-operative with each other to lock said foldback portion in a folded back configuration; and wherein said securing protrusion is located in said recess so that said protrusion is generally in the plane of the lid, and so that the portion of said rim between said grasp tab and said grasping ridges will extend downwardly into said recess when said foldback portion is folded back around said "U"-shaped hinge and said foldback portion is locked in its folded back configuration.

9. A disposable cup lid for covering the open end of a beverage cup, where said cup lid is vacuum formed from an extruded thermoplastic sheet material having an orientation grain caused by extrusion, comprising:

a cover portion and a lip portion;

said lip portion defining a downwardly facing cavity around said cover portion and adapted to receive a corresponding rim of a beverage cup;

said cover portion being generally planar and having a foldback portion therein located near the periphery of said cover portion and extending into said lip portion, said foldback portion spanning a minor segment of said cover portion and said lip portion;

a "U"-shaped hinge portion formed in said cover portion and subtending said foldback portion;

a grasp tab formed adjacent said lip portion and extending outwardly from the periphery thereof in a plane which is generally parallel to the plane of said cover portion;

said foldback portion having a first side, a second side, a first end, and a second end; said first end being coincident with said grasp tab, said second end being coincident with said "U"-shaped hinge, and said first and second sides being parallel one to the other and coincident with said orientation grain;

wherein a pair of generally radially extending and upstanding grasping ridges are formed in said cover portion adjacent said lip portion and radially inwardly from said grasp tab, and extending upwardly above the plane of said cover portion;

a securing protrusion is formed radially in line with said pair of grasping ridges and spaced away from said "U"-shaped hinge at the side thereof remote from said grasping ridges, and extends downwardly from the plane of said cover portion; and a recess is formed below the general plane of said lid;

wherein the spacing between said grasping ridges and the width of said securing protrusion are such that said grasping ridges and securing protrusion are co-operative with each other to lock said foldback portion in a folded back configuration; and wherein said securing protrusion is located in said recess so that the upper surface of said protrusion is generally in the plane of the lid, and so that the portion of said rim between said grasp tab and said grasping ridges will extend downwardly into said recess when said foldback portion is folded back around said "U"-shaped hinge and said foldback portion is locked in its folded back configuration.

10. The disposable cup lid of claim 9, wherein at least a pair of stiffening ribs is formed in the foldback portion of said cup lid in the general vicinity of said pair of grasping ridges.

11. The disposable cup lid of claim 9, wherein at least a pair of stiffening ribs is formed in said recess, in the general vicinity of said securing protrusion.

* * * * *